US012571206B2

(12) United States Patent
Kennelly

(10) Patent No.: US 12,571,206 B2
(45) Date of Patent: Mar. 10, 2026

(54) INSTALLATION OF RIBBON PLATES

(71) Applicant: Illinois Tool Works Inc., Glenview, IL (US)

(72) Inventor: Bernard Joseph Kennelly, Mosman (AU)

(73) Assignee: Illinois Tool Works Inc., Glenview, IL (US)

( * ) Notice: Subject to any disclaimer, the term of this patent is extended or adjusted under 35 U.S.C. 154(b) by 120 days.

(21) Appl. No.: 18/686,341

(22) PCT Filed: Aug. 25, 2021

(86) PCT No.: PCT/IB2021/000534
§ 371 (c)(1),
(2) Date: Feb. 23, 2024

(87) PCT Pub. No.: WO2023/026069
PCT Pub. Date: Mar. 2, 2023

(65) Prior Publication Data

US 2024/0401329 A1 Dec. 5, 2024

(51) Int. Cl.
*E04B 2/70* (2006.01)
*E04B 1/26* (2006.01)

(52) U.S. Cl.
CPC ..... *E04B 2/70* (2013.01); *E04B 1/2604* (2013.01); *E04B 2001/2652* (2013.01)

(58) Field of Classification Search
CPC .. E04B 2/70; E04B 1/2604; E04B 2001/2652; E04B 2/707; E04B 7/04; E04C 3/17
See application file for complete search history.

(56) References Cited

U.S. PATENT DOCUMENTS 4,596,101 A * 6/1986 Brinker ..... E04B 1/2604 52/693
4,604,845 A * 8/1986 Brinker ..... E04B 1/2604 52/696
5,303,520 A * 4/1994 Gozdziak ..... E04C 3/17 52/713
9,360,032 B2 * 6/2016 Dicaire ..... F16B 25/0015
(Continued)

FOREIGN PATENT DOCUMENTS

CN 210530032 U 5/2020
WO 2016191426 12/2016

OTHER PUBLICATIONS

International Search Report and Written Opinion from International Application No. PCT/IB2021/00534, mailed Nov. 30, 2021 (11 pages).

(Continued)

*Primary Examiner* — Rodney Mintz
(74) *Attorney, Agent, or Firm* — Neal, Gerber & Eisenberg LLP

(57) ABSTRACT

There is disclosed a method of installing a ribbon plate over a wall plate, said method comprising, with the ribbon plate arranged over the wall plate, driving into one of the ribbon plate and wall plate at least one fastener extending along a respective preformed passage in the other of the ribbon plate and wall plate, whereby the fastener is guided by the passage to be located correctly in the plate into which it is driven in a connection thus formed between the wall plate and ribbon plate.

14 Claims, 6 Drawing Sheets

(56) References Cited

U.S. PATENT DOCUMENTS

2014/0360123 A1 12/2014 Dicaire
2025/0012071 A1* 1/2025 Volgger ..... E04G 21/185

OTHER PUBLICATIONS

Standards Australia, 2010, Residential timber-framed construction: Non-Cyclonic Areas, AS 1684.2—2010, Standards Australia, NSW. Table 9.19, Sections 6.3.4, 9.2.5, 9.2.8 (10 pages).
Extended European Search Report from European Application No. 21954911.0, mailed Mar. 21, 2025 (6 pages).

* cited by examiner

INSTALLATION OF RIBBON PLATES

PRIORITY CLAIM

This application is a national stage application of PCT/11B2021/000534, filed on Aug. 25, 2021, the entire contents of which is incorporated herein by reference.

The present disclosure relates to ribbon plates. More particularly, the present disclosure relates to a method of installing a ribbon plate over a top plate, and to each of a ribbon plate and top plate configured for such a method.

Timber framing is often employed in building construction, particularly in the construction of houses.

Such framing typically comprises roof framework and supporting wall framework to which the roof framework is connected. Roof framework generally includes trusses. Wall framework typically comprises at least one wall frame including upright members or posts, known as "studs", pieces connected between adjacent ones of the studs, known individually as "nogs" or "noggins" and collectively as "nogging", and one or more elongate members, extending transverse to the studs and connected to upper ends thereof, to form a "top plate"- to which the roof framework is secured and through which loading exerted by the roof/roof framework is transferred to the wall frame in the building.

A structural roof frame member, such as a roof truss bottom chord, which is to be supported by a wall frame is usually, if possible, arranged such that the position at which it rests against the top plate is directly above a stud of the wall frame, such that downward loading (including weight loads) exerted on the wall frame by the roof frame member is in line with the stud, and the top plate is thus not subjected to resulting a bending moment as it would be if roof frame member were offset from the stud along the wall plate. It is also generally desirable, where the wall frame will be prone to upward loading exerted by the roof frame member, including in particular due to "uplift" in the roof structure—which is typically caused by wind—that the roof frame member additionally be fixed to the wall plate at a position directly above a/the stud, whereby the top plate is not subjected to a resulting bending moment that would result from the upward loading if offset from that stud along the top plate. However, it is not always possible or practicable for the roof frame member to rest against and/or be fixed to the top plate at such a position.

Where the roof frame member cannot be fixed directly over a stud, there may be installed, over the top plate (whereby it constitutes a lower top plate), an additional top plate, known as a "ribbon plate", to abut the roof frame member and receive one or more fasteners to secure that member to the wall frame, the ribbon plate affording the wall frame, particularly the upper edge thereof defined by the wall plating, adequate stiffness and strength to transfer the eccentric vertical loads.

Adequate interconnection of the roof frame member and wall frame relies not only on the roof frame member being properly secured to the ribbon plate but also on the latter being properly secured to the underlying top plate.

BRIEF SUMMARY

The present disclosure provides a method of installing a ribbon plate over a top plate, said method comprising, with the ribbon plate arranged over the top plate, driving into one of the ribbon plate and top plate at least one fastener extending along a respective preformed passage in the other of the ribbon plate and top plate, whereby the fastener is guided by the passage to be located correctly in the plate into which it is driven in a connection thus formed between the top plate and ribbon plate.

Preferably, the, each, or at least one said fastener is pre-applied to one of the ribbon plate and top plate, and thus extends in the respective passage therein, prior to the driving thereof into the other of the ribbon plate and top plate.

BRIEF DESCRIPTION OF THE SEVERAL VIEWS OF THE DRAWINGS

The present disclosure will now be described, by way of non-limiting example only, with reference to the accompanying drawings, in which.

DETAILED DESCRIPTION

Figure 1:
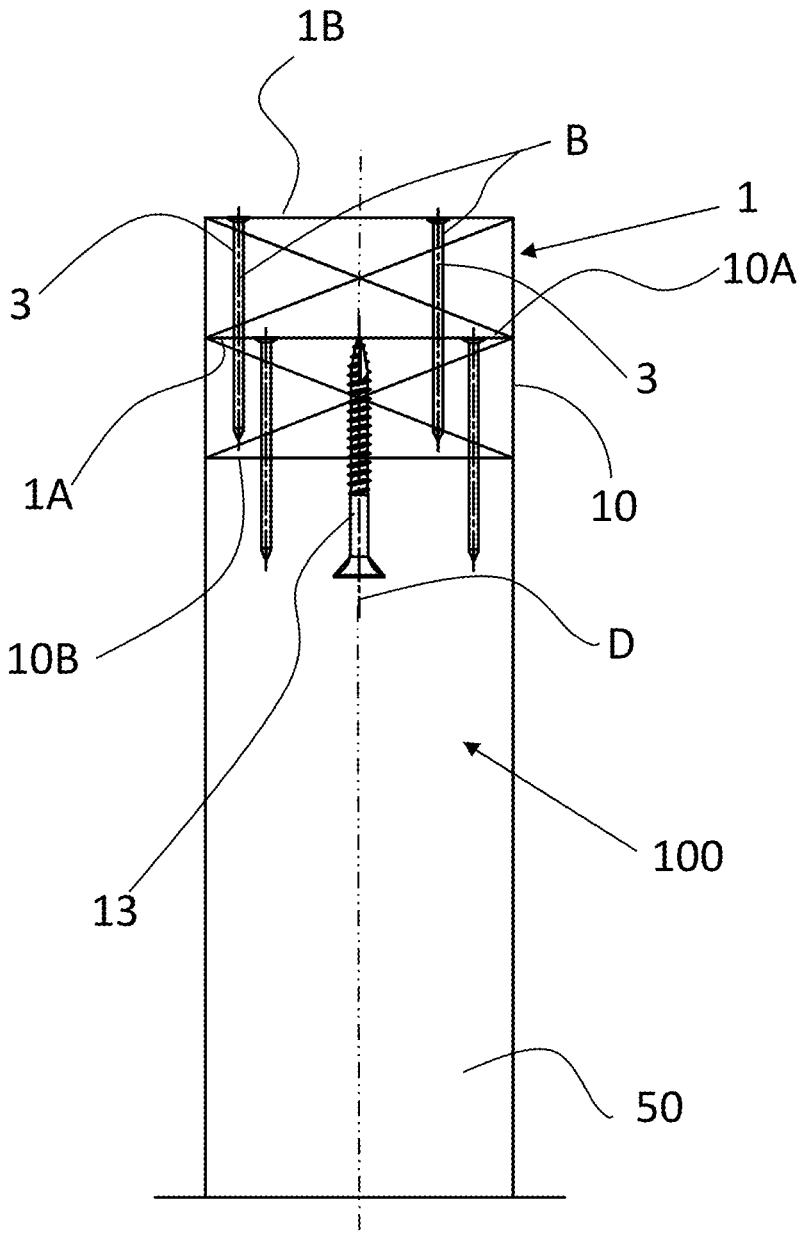
FIG. 1 is a front elevation view showing a ribbon plate preliminarily secured, by one or more nails, to an underlying top plate of a wall frame in the installation of the ribbon plate in accordance with a preferred embodiment of the present disclosure.

FIGS. 1 to 4 show stages in the construction of a timber framed building, in which a ribbon plate 1 is secured to a top plate 10 of a wall frame 100, and a truss 1000 is secured to the ribbon plate 1, whereby the truss 1000 is satisfactorily supported and tied down in the building.

Each of the ribbon plate 1 and top plate 10 comprises a timber member of rectangular cross-section, and will have standard width and depth/thickness dimensions—e.g. a width of 70 mm or 90 mm and a depth/thickness of 35 mm or 45 mm.

The wall frame 100 includes, in addition to the top plate 10, parallel studs secured at upper ends thereof to the top plate 10, one such stud 50 being shown in the drawings. Fabrication of the wall frame 100 preferably precedes installation thereof (i.e. is preferably not in situ).

Referring to FIG. 1, the ribbon plate 1 is placed atop the top plate 10 and located in position relative thereto, such that the ribbon plate 1 is aligned transversely with the top plate 10, and a lower/bottom face 1A of the former abuts the upper/top face 10A of the latter, and nails 3 are driven downwardly, through the ribbon plate 1, into the top plate 10, preliminarily securing the ribbon plate 1 to the top plate 10. The ribbon plate may be offset along its length by 70 or 90 mm longer of shorter at either or both ends to form a lap joint/connection with/to and abutting wall frame.

Figure 6:
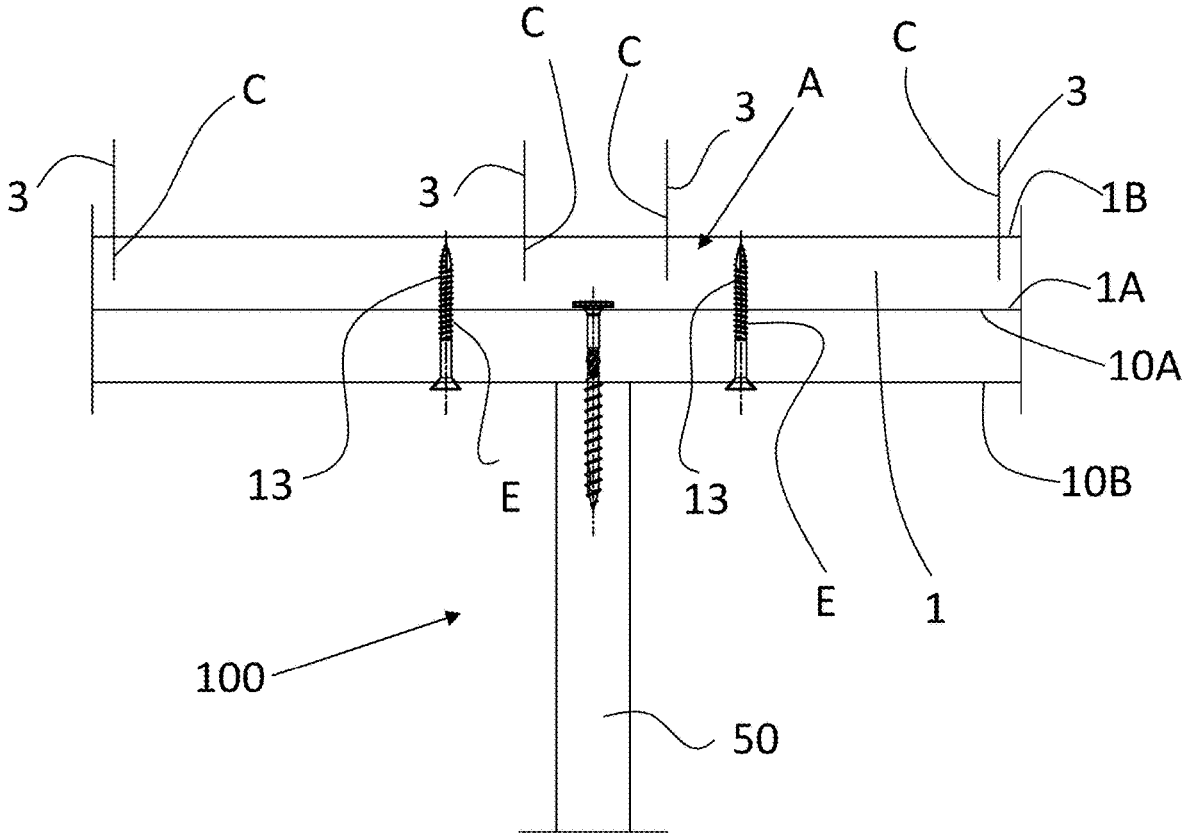
FIG. 6 is a side elevation view showing an exemplary arrangement of nails in the ribbon plate and an exemplary arrangement of screws pre-applied to the top plate.

Referring to FIG. 6, it may be a pre-assembly A, comprising the ribbon plate 1 and nails 3 driven into the ribbon plate 1 through the upper/top face 1B thereof, that is placed atop and located relative to the top plate 1—whereby respective voids occupied by leading portions of the nails 3 as a result of their being driven into the ribbon plate 1, through face 1B thereof—define within the ribbon plate 1 passages which guide the nails 3 during driving thereof downwardly, through the ribbon plate 1, into the top plate 10. More likely to be preferable, however, would be that the ribbon plate 1 is placed/located atop the top plate 10 and the nails 3 thereafter driven into and through the ribbon plate 1 and thence into the wall plate 10. In either case, the nails 3 are applied to the ribbon plate 1 so as to be arranged in pairs B at spaced positions C therealong.

In each pair B, the nails 3 are arranged to opposite sides of a central vertical plane D through the ribbon plate 1, preferably in a line perpendicular to the plane D and equidistantly spaced from that plane, and such that they extend perpendicular to the face 1A or 10A.

Figure 2:
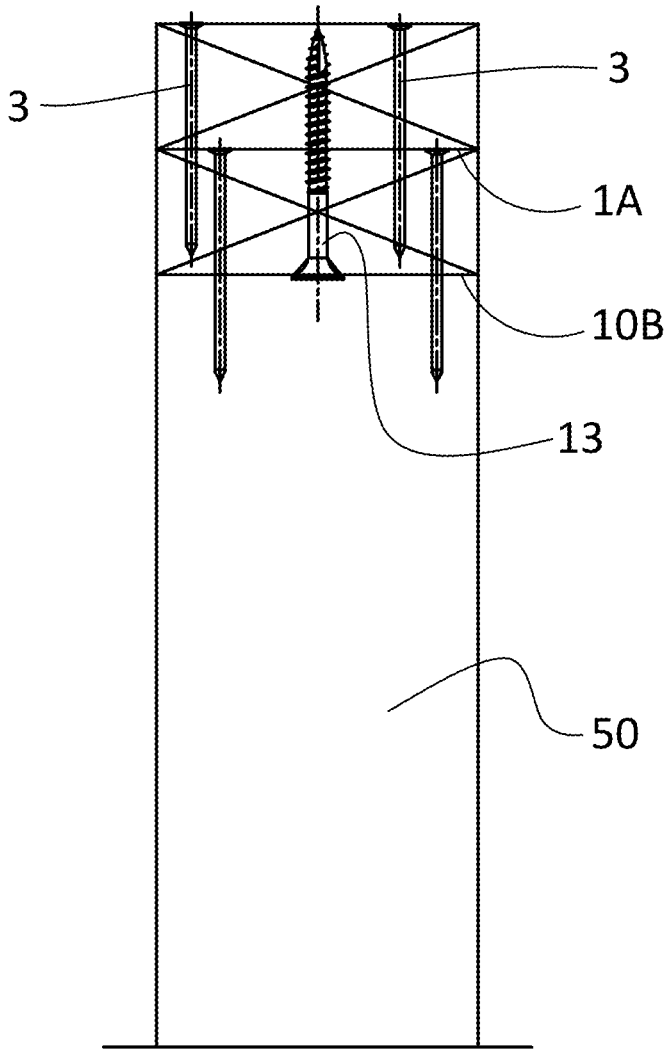
FIG. 2 is a front elevation view showing the ribbon plate finally secured, by at least one screw, to the top plate in the installation.

Referring to FIG. 2, with the ribbon plate 1 thus anchored to the wall plate 10 by the nails 3, screws 13—each comprising a forwardly convergent tip or point 13A, a shank 13B and a tapered (rearwardly divergent) head 13C—are driven upwardly, through the wall plate 10, into the ribbon plate 1 (the anchorage of the ribbon plate 1 by the nails 3 securing it against dislodgement by the screws 13 when the leading ends of the screws pass through the wall plate upper surface 10A), thereby forming tie-down connections between the ribbon plate 1 and wall plate 10.

Referring again to FIG. 6, at each of spaced apart positions E along the wall plate 10, a respective screw 13 is applied to, or a respective hole to receive it formed in, the wall plate 10—prior to placement/location of the ribbon plate 1/pre-assembly A atop the wall plate 10. Each screw 13, whether so applied or inserted into a hole so formed, is guided in the wall plate 10 during the driving thereof at a respective position E. More particularly, each screw 13 extends along a passage—comprising either a said pre-formed hole that receives it or a void it occupies as a result of its being pre-applied—in the wall plate 10, which passage defines a guide for the screw.

Advantageously, each screw 13, owing to its being guided during driving thereof into the ribbon plate 1, penetrates the ribbon plate 1 at a correct position and in a correct orientation.

The application of the pre-applied screw(s) 13 and/or formation of the pre-formed screw hole(s) preferably precedes not only the placement/location of the ribbon plate 1/pre-assembly A but also the installation of the wall frame 100 and/or securing of the wall plate 10 to the upper ends of the studs 50 in the fabrication of the wall frame 100.

At each position E, the respective screw 13 is arranged such that the central axis thereof lies in the plane D and extends perpendicular to the face 1A or 10A.

Each screw 13 is configured and lengthways dimensioned such that a correct penetration thereof into the ribbon plate 1 is realised upon the rear/end face of the tapered head 13C becoming flush with the surface 10B. Without departure from the present disclosure, the screw heads may instead have flat, rather than tapered, undersides and be configured and lengthways dimensioned such that a correct penetration thereof into the ribbon plate 1 is realised upon the underside coming into abutment with the surface 10B. In either case, the correct penetration can, advantageously, be readily established and checked/confirmed—by observing when/that the screw has been driven fully home, i.e. the flat rear face or underside of the head is flush or in abutment, respectively, with the surface 10B—e.g. upon attainment of an automatic torque cut-out in a powered device used to drive the screw, and/or visually or by feel.

Figure 3:
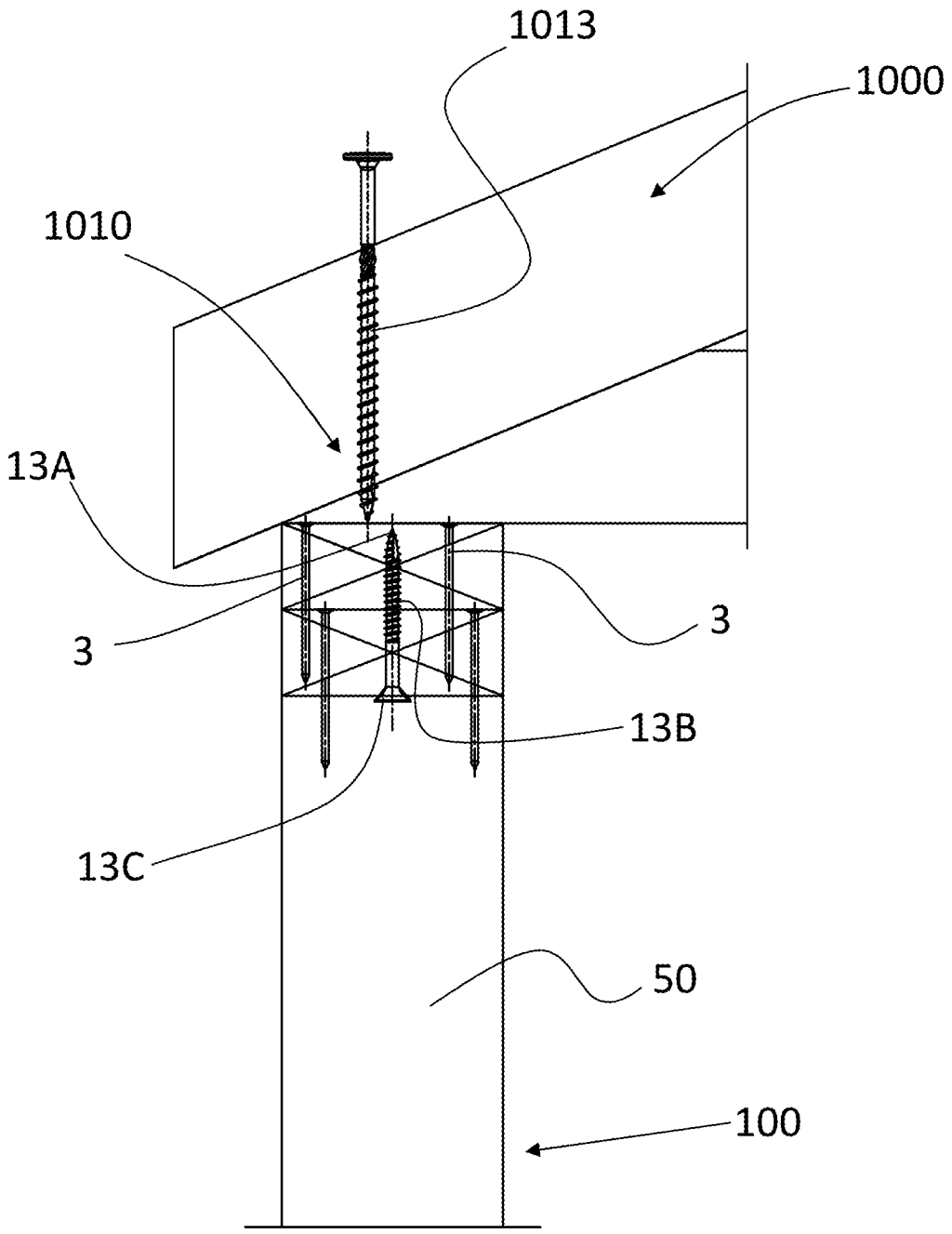
FIG. 3 is a front elevation view showing a roof truss positioned against the ribbon plate prior to being secured to the ribbon plate.

Referring to FIG. 3, the truss 1000 is—preferably subsequent, but possibly prior, to the driving of the screws 13—located in position atop the ribbon plate 1. Thereafter, referring to FIG. 4, at least one screw 1013 is driven downwardly, through a heel 1010 of the truss 1000, into the ribbon plate 1, to secure the truss 1000 to the ribbon plate 1. Preferably, before the truss 1000 is positioned atop the ribbon plate 1, the or each screw is 1013 is applied to, or a respective hole to receive it provided/formed in, the heel 1010. The/each screw 1013, whether so applied or inserted into a hole so provided/formed, is guided in the heel 1010 during the driving thereof. More particularly, the or each screw 1013 extends along a respective passage—comprising either a said preformed hole that receives it or a void it occupies as a result of its being pre-applied—in the heel, which passage defines a guide for the screw 1013 The/each passage/fastener 1013 may be formed/provided/applied in the heel and/or elsewhere in the truss 1000—through one or more members of the truss 1000 and/or applied thereto—e.g. as disclosed in any one of international patent application nos. PCT/US2016/033931, PCT/US2017/050286 and PCT/US2019/034162 the disclosures of which are incorporated herein by reference.

Figure 4:
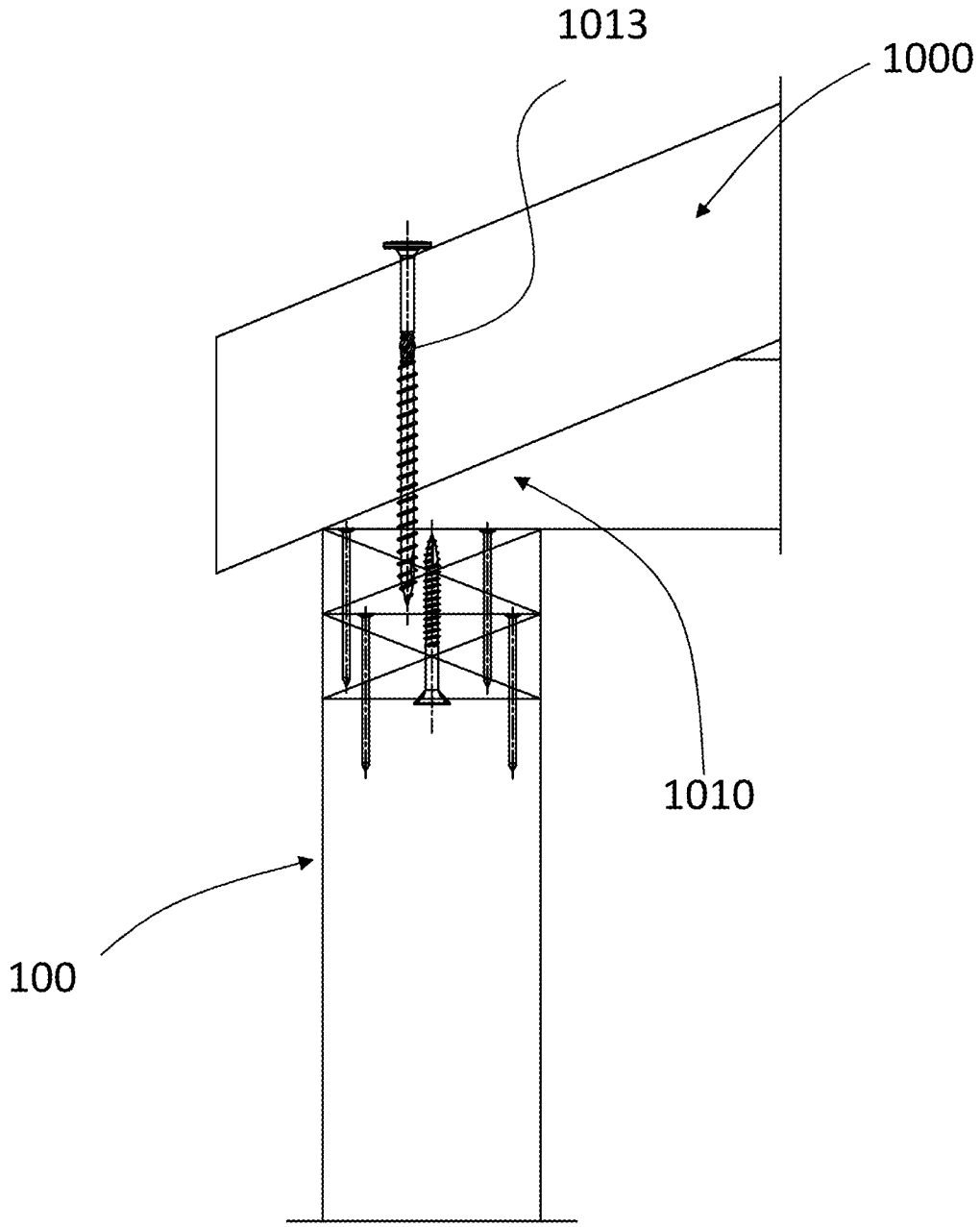
FIG. 4 is a front elevation view showing the roof truss secured, by at least one screw, to the ribbon plate.
Figure 5:
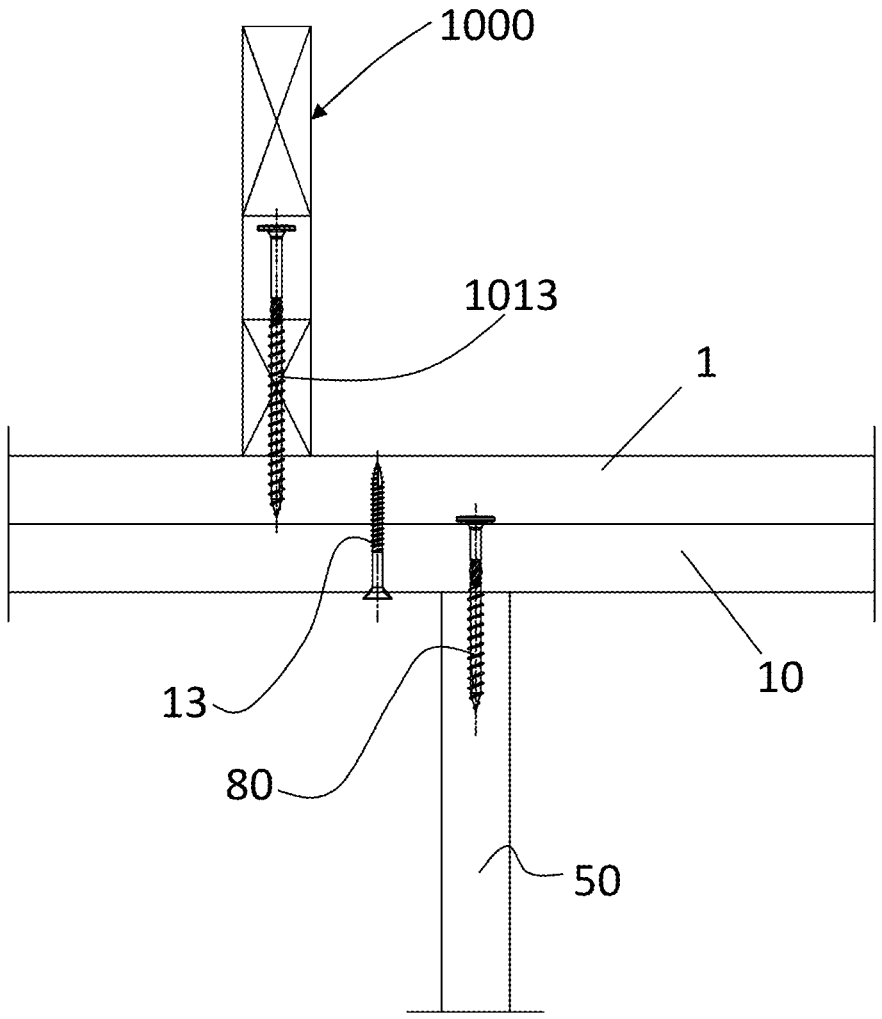
FIG. 5 is a side elevation view showing relative locations, along the ribbon and top plates, of the truss and a stud of the wall frame, and of screws securing the ribbon plate to the top plate and the truss to the ribbon plate.

FIG. 5 is a side elevation view of the arrangement shown in FIG. 4, showing relative locations, along the ribbon 1 and wall 10 plates, of the truss 1000 and a stud 50 of the wall frame 100, and of screws 13 and 1013 securing the wall plate 10 to the ribbon plate 1 and the truss 1000 to the ribbon plate 1, and also a screw 80, driven downwardly through the wall plate 10 and into stud 50 to secure the wall plate 10 to the stud 50.

The word "timber" as used herein refers, except where context otherwise requires, to both solid or natural timber and "mass timber", the latter comprising wood constituents—such as veneers, boards, strands, fibres or particles—and adhesive or other substances/means holding the wood constituents together, and including laminated timber, such as glulam, laminated veneer, such as laminated veneer lumber (LVL), fibreboard, such as medium-density fibreboard and high-density fibreboard, particleboard and oriented strand board (OSF).

While various embodiments of the present disclosure have been described above, it should be understood that they have been presented by way of example only, and not by way of limitation. It will be apparent to a person skilled in the relevant art that various changes in form and detail can be made therein without departing from the spirit and scope of the present disclosure. Thus, the present disclosure should not be limited by any of the above described exemplary embodiments.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A method of installing a ribbon plate over a wall plate, said method comprising:

arranging the ribbon plate over the wall plate and against an intermediate plate disposed on the wall plate;

driving a fastener into one of the ribbon plate and wall plate such that the fastener extends along a preformed passage in an other of the ribbon plate and wall plate, and driving the fastener into, through or extending along a passage in the intermediate plate, and such that the fastener is guided by each passage to be located correctly in the ribbon plate into which the fastener is driven in a connection formed between the wall plate and the ribbon plate, thereby securing a roof frame member to a wall frame; and pre-applying the fastener to said one of the ribbon plate and the wall plate such that the fastener extends in the preformed passage prior to driving the fastener into the other of the ribbon plate and the wall plate.

2. The method of claim 1, wherein the ribbon plate is a top wall plate.

3. The method of claim 1, wherein the ribbon plate is a bottom ribbon plate.

4. The method of claim 1, which includes arranging the ribbon plate directly against the wall plate.

5. The method of claim 1, which includes forming the preformed passage via the fastener.

6. The method of claim 1, which includes partially forming the preformed passage by drilling a pilot hole.

7. The method of claim 1, wherein the fastener is threaded and driving the fastener includes rotating the fastener.

8. The method of claim 1, wherein the fastener is a nail and driving the fastener includes applying a force to a head of the fastener.

9. The method of claim 1, wherein the preformed passage extends vertically.

10. The method of claim 1, wherein the preformed passage extends upwardly from a lower face of the wall plate, and which includes driving the fastener guided by the preformed passage upwardly into a lower face of the ribbon plate.

11. The method of claim 1, wherein the preformed passage extends downwardly from an upper face of the ribbon plate, and which includes driving the fastener guided by the preformed passage downwardly into an upper face of the wall plate.

12. The method of claim 1, which includes driving the fastener to an extent that a trailing end of the fastener is positioned at or against a face of the ribbon plate in which the fastener is guided by the preformed passage, and has a length such that the trailing end is arranged to indicate that the fastener extends to an appropriate degree in the ribbon plate.

13. The method of claim 1, which includes driving the fastener through the passage in the intermediate plate.

14. The method of claim 13, which includes securing the intermediate plate to the wall plate.

* * * * *